US006065372A

United States Patent [19]

Rauch

[11] Patent Number: 6,065,372

[45] Date of Patent: May 23, 2000

[54] POWER WRENCH FOR DRILL PIPE

[76] Inventor: Vernon Rauch, 1069 Hwy. 17, Garden Valley, Id. 83622

[21] Appl. No.: 09/089,750

[22] Filed: Jun. 2, 1998

[51] Int. Cl.[7] ..... B25B 17/00

[52] U.S. Cl. ..... 81/57.15; 81/57.33; 81/57.2

[58] Field of Search ..... 81/57.15, 57.11, 81/57.2, 57.33, 57.42

[56] References Cited

U.S. PATENT DOCUMENTS

| | | | |
|---|---|---|---|
| 1,925,970 | 9/1933 | Pennington | 81/57.2 |
| 2,400,712 | 5/1946 | Prather et al. . | |
| 2,523,159 | 9/1950 | Stone . | |
| 2,544,639 | 3/1951 | Calhoun | 81/57.2 |
| 2,746,329 | 5/1956 | Paget . | |
| 2,928,301 | 3/1960 | Beeman et al. . | |
| 3,122,211 | 2/1964 | Wilson et al. . | |
| 3,308,691 | 3/1967 | Guier . | |
| 3,392,609 | 7/1968 | Bartos . | |
| 3,521,509 | 7/1970 | Duke et al. . | |
| 3,774,481 | 11/1973 | Goodman . | |
| 4,178,817 | 12/1979 | Gibson . | |
| 4,221,269 | 9/1980 | Hudson | 81/57.2 |
| 4,381,685 | 5/1983 | Brooks . | |
| 4,774,861 | 10/1988 | Hamilton et al. | 81/57.2 |
| 5,351,582 | 10/1994 | Snyder et al. | 81/57.42 |
| 5,660,087 | 8/1997 | Rae | 81/57.2 |
| 5,791,206 | 8/1998 | Daigle et al. | 81/57.2 |

*Primary Examiner*—James G. Smith
*Assistant Examiner*—Lee Wilson
*Attorney, Agent, or Firm*—Ken J. Pedersen; Barbara S. Pedersen

[57] ABSTRACT

A motorized wrench for spinning together (or apart) lengths of drill pipe as typically used in water well drilling. A single motor is connected by a pair of drive chains to two toothed drive rollers to spin the rollers and, thus, spin drill pipe engaged against them. The pipe is so engaged by means of a smooth idler roller within a pivot arm driven open or closed by an air ram. The invention is typically supported via light wire cable from a drill rig mast and when so supported is fast and easy to place, operate, and remove. The preferred configuration of the device operates on hydraulic power and compressed air, both of which are normally present on drill rigs.

5 Claims, 3 Drawing Sheets

POWER WRENCH FOR DRILL PIPE

BACKGROUND OF THE INVENTION

1. Field of the Invention

The invention relates generally to the field of powered tools and more specifically to the field of machine wrenches for making or breaking threaded pipe joints.

2. Related Art

Drilling long holes in earth, whether in rock or unconsolidated material and whether for water, oil, exploration, or other purpose, invariably requires the connection of lengths of round or nearly round drill rod or drill pipe. Such drill rod or pipe is normally connected by threading the male threads at the bottom of one pipe into the female threads at the top of the other pipe, every drill pipe having male and female threads at opposing ends. Drill holes are advanced by "making" increasingly longer drill strings by spinning together lengths of such pipe. Conversely, the drill strings are subsequently removed and the drill pipe is recovered by reversing the process, thus "breaking" the pipe joints by spinning them apart. The present invention provides significantly improved means to accomplish the necessary spinning of drill pipes for making and breaking connections. The preferred embodiment described herein is directed toward water well drilling pipes, including casing, of generally 4" to 8" outside diameter, although it is reasonably adaptable to other round drill pipes and rods of other diameters.

A variety of related art has addressed drill pipe spinning by way of various configurations of motors, drive trains, and means for moving and retaining pipe sections. Brooks in U.S. Pat. No. 4,381,685 (issued May 3, 1983) discloses a tool for rotating a length of pipe to make or break a pipe joint comprising a single motor driving a single drum with serrated surface which imparts spinning motion to the subject pipe section when it is pressed against the drive drum by way of a C-shaped clamp and manpower. Hudson in U.S. Pat. No. 4,221,269 (issued Sep. 9, 1980) discloses a "pipe spinner" comprising three rotary hydraulic motors mounted coaxially within three urethane coated drive rollers which impart spin when pipe is pressed within the three rollers by way of one or two hydraulic rams. Gibson in U.S. Pat. No. 4,178,817 (issued Dec. 18, 1979) discloses a powered wrench comprising a single motor driving, by way of worm gear, a single "driving roll" with flattened teeth and embracing the drill pipe by way of idlers within an arcuate retainer closed by chain and hooks. Goodman in U.S. Pat. No. 3,774,481 (issued Nov. 27, 1973) discloses a device much like Gibson with a single motor, worm gear drive, and strap and idler means for enclosure but with various drive means including double drive rollers in one embodiment and an "endless toothed belt" in another. Duke in U.S. Pat. No. 3,521,509 (issued Jul. 21, 1970) discloses a power wrench comprising a single motor with a single ring gear driving two frictional contact wheels and an "idle wheel housing" with air ram telescope to close the pipe on the drive wheels. Bartos in U.S. Pat. No. 3,392,609 (issued Jul. 16, 1968) discloses a "well pipe spinning unit" comprising a single rotary pneumatic motor with gear train driving four pairs of drive rollers which engage a pipe length upon closure by a single piston and cylinder mechanism. Guier in U.S. Pat. No. 3,308,691 (issued Mar. 14, 1967) discloses an unusual resilient shock absorbent collar configured around the pipe and within an endless chain which is driven by a single motor. Other power wrenches are disclosed in other patents. None, however, describe the particular configuration of components or realize the inherent advantages of the present invention.

SUMMARY OF THE INVENTION

The invention is a much improved pipe spinning tool to make faster and easier the process of assembling pipe lengths together and, subsequently, breaking the pipe joints apart. The preferred components of the invention are: (1) structural members for supporting components and the tool itself and safely enclosing moving parts, (2) a single motor, (3) a pair of drive chains and double sprocket, (4) a pair of toothed drive rollers, and (5) means for embracing the pipe against the drive rollers comprising a pivot arm, a smooth idler roller, and an air ram with control valve. Supporting elements for the invention include power sources for the motor and for an actuator such as an air ram. In the preferred embodiment, these are a hydraulic power supply for the motor and an air compressor for the air ram.

The invention is practiced by first positioning it about the subject pipe length and closing it upon the pipe by means of actuating the air ram to close the smooth idler roller inward toward, and still parallel to, the pipe and the drive rollers, so that near-equal pressure on the pipe is exerted by all three rollers. The motor is then actuated to spin the two toothed drive rollers and, thus, spin the pipe. The invention is particularly directed toward use in water well drilling and in conjunction with well drilling rigs. Normally it would be used to impart a clockwise-downward spin to join two pipes together and "make" a joint. It is particularly useful for threading an additional pipe into an existing string of pipe hanging from the drill rig. A relatively light tool is sufficient for this purpose because further clockwise-downward motion during the drilling process will better seat and connect the male-female threaded joints throughout the drill string until every joint is fully seated. "Breaking" the joint, in the course of disassembling the drill pipe string, is normally done with conventional drill rig equipment by first hanging all but the top pipe of the drill string from the "slip" plate on top of the turntable, then securing and immobilizing the top pipe with tongs secured to the drill rig, and then rotating the turntable (and the balance of the drill string) in the clockwise-down direction.

DESCRIPTION OF THE PREFERRED EMBODIMENTS

Figure 1:
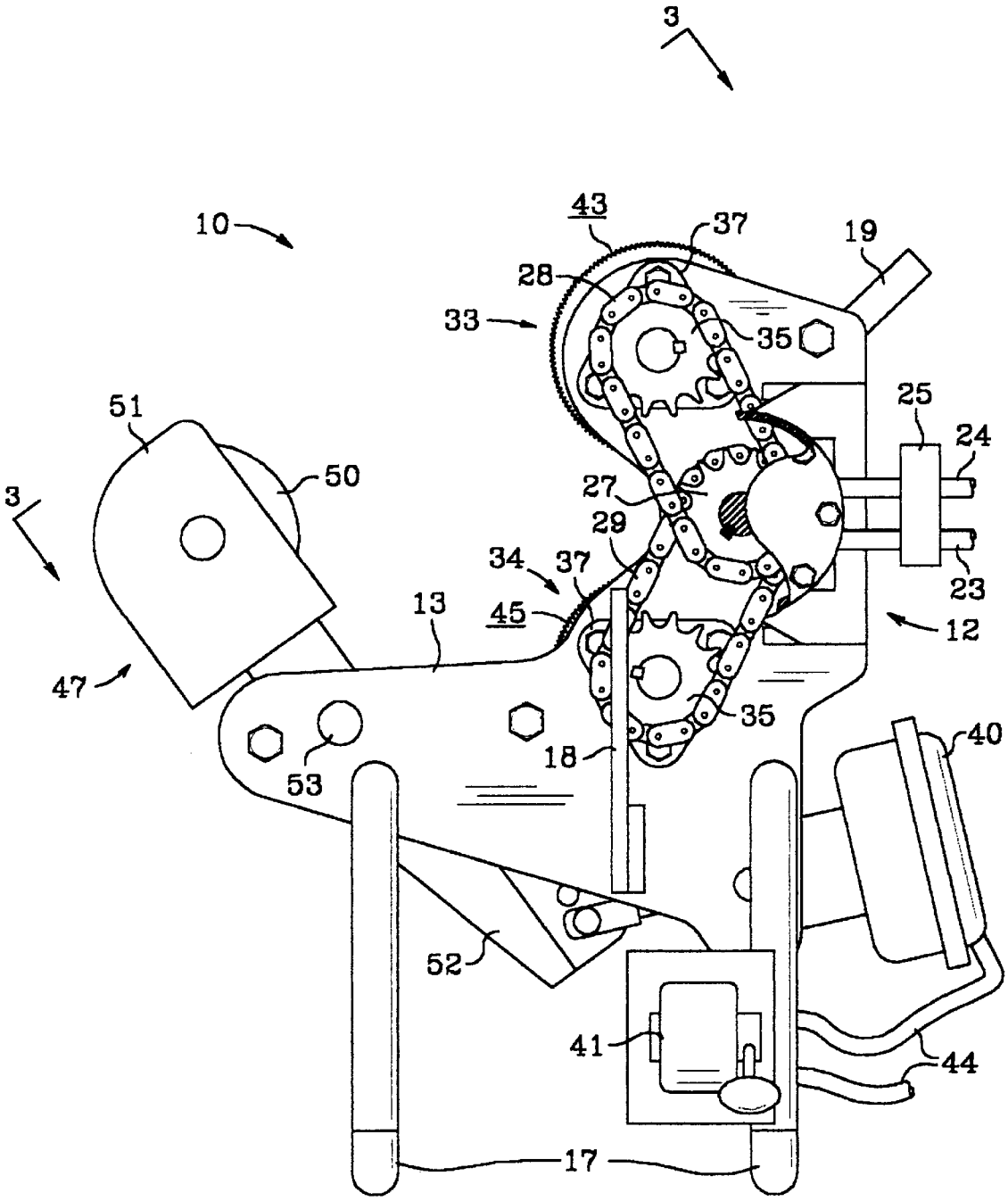
FIG. 1 is a top plan view of one embodiment of the invented power wrench, with the pivot arm and idler roller in the open position and the motor and chain guard cover cut-away for clarity.
Figure 2:
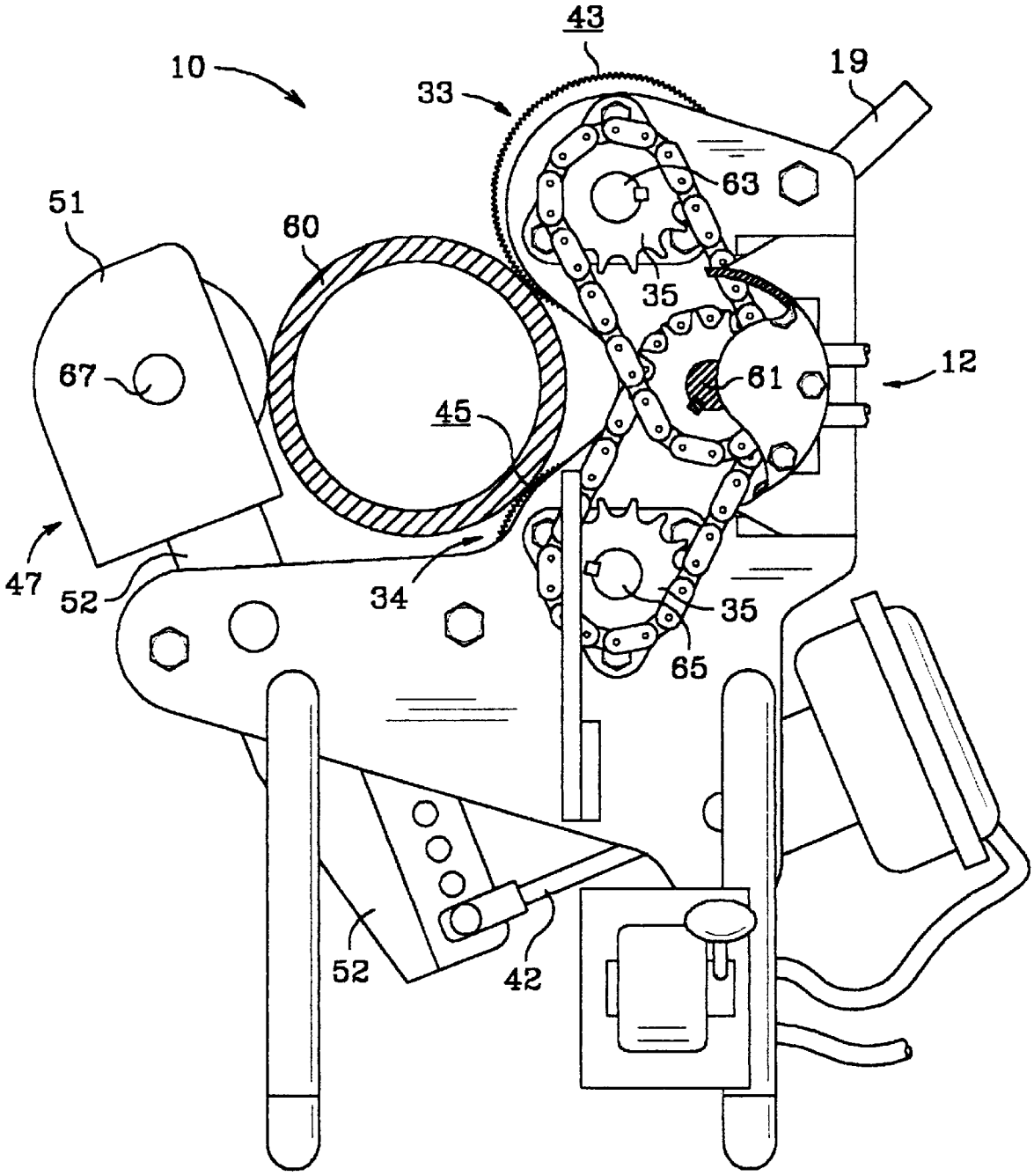
FIG. 2 is a top plan view of the power wrench of FIG. 1, with the pivot arm and idler roller closed to engage a pipe against the drive rollers. The motor and chain guard are cut-away for clarity.
Figure 3:
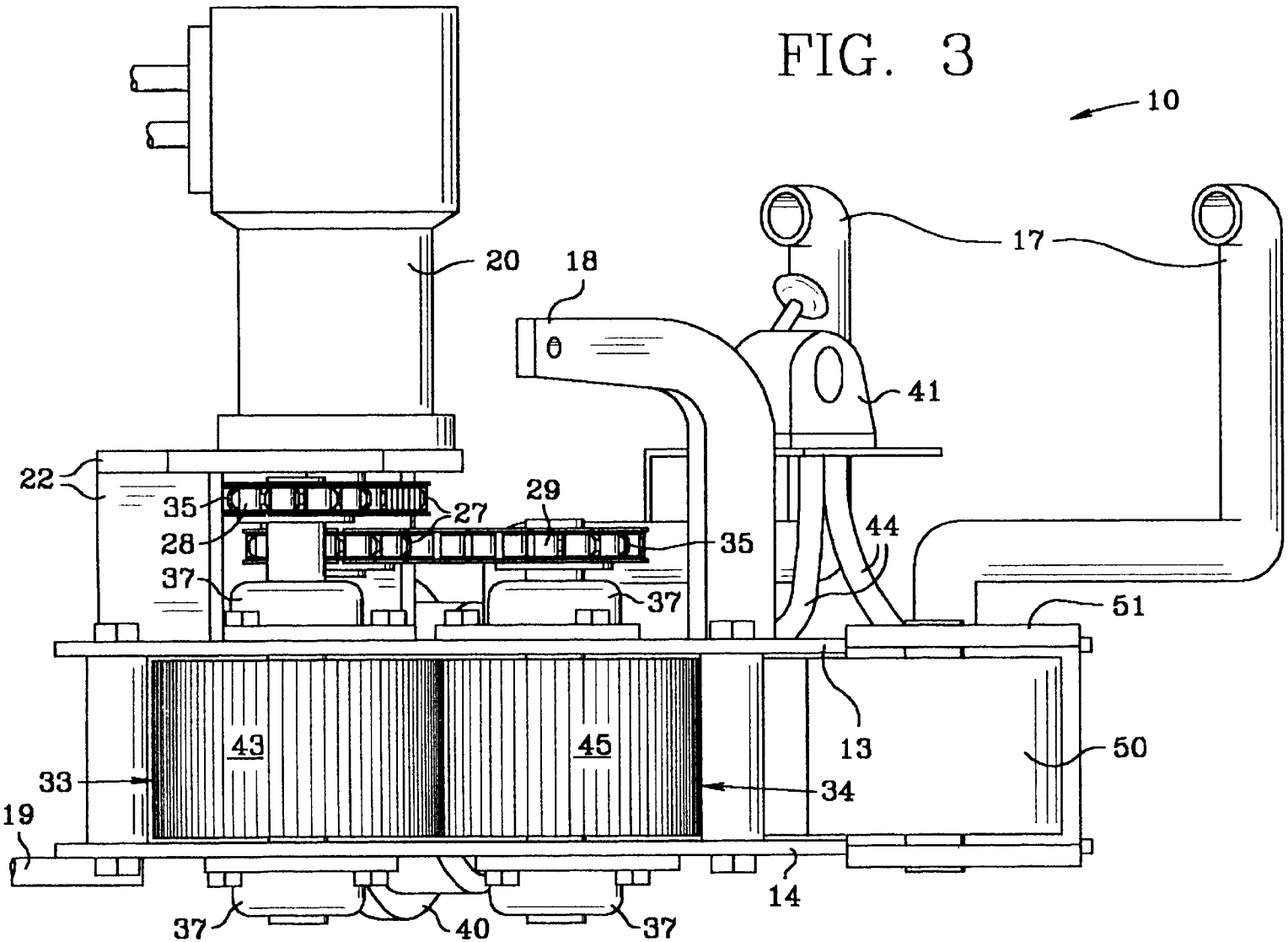
FIG. 3 is a side elevation view of the power wrench of FIG. 1.

Referring to the FIGS. 1, 2, and 3, there are illustrated the preferred components of the inventive power wrench device 10. Nearly all the preferred elements are identified in each of the three figures, and FIG. 2 shows, in addition, a pipe length 60 in position for spinning. For descriptive purpose, the essential elements of the power wrench 10 are identified to two functional systems: the "drive assembly" 12 and the engagement system which includes "engagement assembly" 47. An actuator, such as air ram rod 42 or other powered or manual means, may be considered part of the engagement system, and it links the drive and engagement assemblies and actuates the engagement assembly.

The top cheek plate 13 and the bottom cheek plate 14 (shown in FIG. 3), with attendant bolts and spacers, form the structural base of the drive assembly 12. The cheek plates of the preferred embodiment are fabricated of ⅜ T-1 steel plate, although those skilled in the art will recognize functional alternatives. The pattern of the cheek plates, including axle holes for rollers and engagement assembly pivot shaft and threaded holes for mounting bolts, may vary to the extent that it will accommodate the operation of the essential elements.

A single motor 20 moves the drive train of the invention. The motor 20 of the preferred embodiment is a hydraulic motor powered by an isolated hydraulic pump of the type which is usually carried on a mobile drill rig. A hydraulic motor such as the Eaton "S" Series at 370 $cm^3/r$ is known to produce good results. Air, electric, or other motors would conceivably perform the same function. Pressurized hydraulic fluid is delivered to the motor 20 from the pump (not shown) by way of the hydraulic power hose 23. "Spent" or depressurized fluid is returned to a reservoir at the pump through the return hose 24. Located near the motor 20 and between the hydraulic hoses 23 and 24 is a hydraulic by-pass valve system 25. In the event undesirably high hydraulic pressure develops between the pump and the motor, the by-pass valve will shunt the pressurized fluid back to the pump reservoir. The motor 20 is secured to a mounting bracket 22 which positions the motor a sufficient distance above the top cheek plate 13 to accommodate a drive axle of the motor and the double drive sprocket 27 thereon located.

The drive train begins at the double drive sprocket 27 attached to, and beneath, the motor 20. Drive sprocket 27 may be a single rotating member with upper and lower toothed sprocket portions. The two sprocket portions may be integral or otherwise attached to each other to create the double sprocket. Referring to FIG. 3, the drive sprocket 27 two toothed portions are configured co-axially on the drive sprocket axle 61, one on top of the other. Endless chain drives 28 & 29 are seated within the teeth of each of the respective drive sprocket 27 toothed portions. Left and right drive chains 28 & 29 extend from the drive sprocket 27 to enmesh upon teeth of the respective left and right roller sprockets 35. The preferred embodiment features fourteen-toothed sprockets with taper lock and number 50 chain drives of ⅝" pitch as the sprocket and chain configuration.

At opposing ends of each chain from the double drive sprockets 27 are left and right rollers 33, 34, which contact and spin the pipe length received in the invented tool 10. The left and right rollers 33, 34 each have a drive sprockets 35 at or near the top end of their axles 63, 65. The drive sprockets 35 receive and are driven by the left and right drive chains 28, 29. Each of the axles of the rollers 33, 34, in the preferred embodiment, extends through the top and bottom cheek plates 13 & 14 to bearings 37 (such as a Fafnir flanged sealed ball bearing) and each end of each axle is secured to respective cheek plates by way of said bearings 37.

The pipe-spinning, toothed outer surfaces 43, 45 of the rollers 33, 34 are configured co-axially with their respective roller sprocket 35 about each roller. Whereas the motor 20 and double drive sprocket 27 are the beginning of the drive train, the left and right drive rollers 33 & 34 are the end of it and their toothed outer surfaces 43, 45 are the elements which actually impart a spin to the drill pipe 60. The drive rollers of the preferred embodiment are approximately 5" in diameter and 3" wide. Frictional contact to the drill pipe 60 is much enhanced by teeth formed within the outer surfaces 43, 45 of the drive rollers 33 & 34.

Engagement of the drill pipe 60 to the drive rollers 33 & 34 in a manner sufficient to impart the desired spinning motion is accomplished by pivotal action of the engagement assembly 47 to press the pipe 60 into firm frictional contact with the left and right drive rollers. Contact to the pipe is made by an idler roller 50 with axle 67 mounted to one end of a pivot arm 52 and encased within the idler roller cover 51. The idler roller 50 is similar in size and shape to the drive rollers 33 & 34 except it is preferably smooth faced. Mounted to the opposite end of the pivot arm 52 is a double acting air ram 40 which may be operated to both open and close the pivot arm and idler roller. The air ram 40 is secured to the drive assembly 12 by means of a bracket and is connected to the preferably rigid, straight pivot arm 52 by means of a linkage rod 42. Pneumatic power is supplied to the air ram 40 from a compressor of the type normally found on a drill rig. The compressed air flow is conducted through an air hose 44 first to a two position valve 41 and then to the air ram 40. An air ram such as MGM "C" Model brake assembly with 7" diaphragm and 3" stroke is known to be effective to this application. The location of the pivot point 53 is calculated to provide mechanical advantage to the air ram upon the idler roller.

Thus, the drive system 12 comprises the two rollers 33, 34 and the double drive sprocket 27, which are arranged in generally a v-shape at about a 125–145° angle, with the roller axles parallel to each other. The idler roller 50 opposes and is distanced from the rollers 33, 34 and drive sprocket 27 by a pipe-receiving space. Thus, the rollers 33, 34 contact the pipe at points on the pipe surface preferably about 80–100° from each other relative to the pipe center axis. The idler roller contacts the pipe at a point across the pipe from the rollers 33,34, preferably located on a line intersecting the pipe axis perpendicular to a plane extending through the axles of the rollers 33, 34. The invented system, therefore, allows the pipe length to be "clamped" between the drive assembly and the engagement assembly for spinning into proper engagement with another pipe length. The invented tool 10 does so with reliable and relatively simple systems for both engagement and driving.

The invention is positioned for use by hanging it from a cable attached near the top of the drill rig mast. The cable bottom is attached at an appropriate height to the eyelet end of the hanging arm 18, which is positioned over the center of gravity of the power wrench 10. With the wrench thus un-weighted and balanced, an operator can grasp the wrench by the pair of handles 17 and conveniently move it to the subject drill rod 60 for spinning or move it away from the drill rod to an out of the way place. The stop bar 19 is attached to the drive assembly 12 to stop the counter-clockwise (downward) resistance reaction the drill string imparts to the power wrench; the stop bar should be butted against a substantial structural member such as a mast post before spinning is started.

In use, the power wrench 10 is swung to the drill rod 60 to be spun. Normally the drill rod 60 would be hanging loosely by a swivel from the drill rig mast, its lower, male-threaded end nested within the top, female-threaded end of the top rod of the drill string which is supported at the top of the turntable. With the engagement assembly 47 open, the tool is moved to and held against the drill rod 60. Upon contact, the air ram control valve 41 is switched and the engagement assembly 47, and more particularly the idler roller 50, are closed upon the drill rod 60, which is forced to a tight fit between the idler roller 50 and the left and right drive rollers 33 & 34. The hydraulic motor 20 is then started, gradually at first to allow the reaction force of the pipes to move the stop bar 19 against the mast. So positioned, the power wrench is stopped from spinning itself and the hydraulic pressure to the motor may be increased for faster spinning. Typically, the spinning process requires only a few seconds and is accomplished when the two pipe sections seat against each other. Thus seated, the hydraulic motor is stopped from turning, is stopped from discharging the pressurized hydraulic fluid, and pressure in the hydraulic power hose 23 immediately increases toward the maximum pressure available. To avoid unduly stressing the tool and drill pipe, the hydraulic by-pass will activate, at a preset pressure, to reroute the pressurized fluid around the motor and back to the reservoir. The motor 20 may then be turned off, the engagement assembly 47 opened, and the power wrench moved away to continue the drilling process.

Although this invention has been described above with reference to particular means, materials and embodiments, it is to be understood that the invention is not limited to these disclosed particulars, but extends instead to all equivalents within the scope of the following claims.

I claim:

1. A spinning tool for assembling threaded pipe lengths together, the tool comprising:

a base;

a motor connected to the base;

a drive system connected to the base and comprising:

a double drive sprocket operationally connected to the motor and having an axle and comprising coaxial upper drive sprocket and lower drive sprocket;

a first roller located a distance from the upper drive sprocket and having an axle parallel to the double drive sprocket axle and having a first roller sprocket;

an upper chain drive operatively seated with and connecting the upper drive sprocket and the first roller sprocket;

a second roller located a distance from the lower drive sprocket and having an axle parallel to the double drive sprocket axle and having a second roller sprocket; and a lower chain drive operatively seated with and connecting the lower drive sprocket and the second roller sprocket;

wherein the first roller and upper chain lie in a first line intersecting the double drive sprocket axle, and the second roller and lower chain lie in a second line intersecting the double drive sprocket axle, so that said first line is at an angle to said second line to make the drive system generally a v-shape; and an engagement system for clamping the pipe length against the first and second rollers, the clamping system comprising:

a pivot arm connected to and extending from the base to be spaced from the drive system and generally parallel to a line extending between the first roller and the second roller, so that the tool has a space between the pivot arm and the drive system for receiving a pipe length;

an idler roller rotatably connected to the pivot arm and extending toward the drive system for contacting a pipe length received in the tool parallel to the axles of the first and second rollers;

and an actuator for moving the pivot arm to place the idler roller against the pipe length;

wherein the pivot arm and actuator are adapted to clamp the pipe length against the first and second rollers, so that the rollers rotate the pipe length on its axis.

2. The tool as in claim 1, wherein the actuator comprises an air ram connected to the base and operatively connected to the pivot arm for pivoting the pivot arm toward and away from the drive system to open and close the tool.

3. The tool as in claim 1, wherein the pivot arm is a generally straight, elongated rigid arm.

4. The tool as in claim 1, wherein the motor is a hydraulic motor.

5. A spinning tool for assembling threaded pipe lengths together, the tool comprising:

a base;

a single motor connected to the base;

a v-shaped drive system connected to the base and comprising:

a double drive sprocket operationally connected to the single motor and having a axle and comprising coaxial upper drive sprocket and lower drive sprocket;

a first roller located a distance from the upper drive sprocket, having an axle parallel to the double drive sprocket axle and having a first roller sprocket;

an upper chain drive operatively seated with and connecting the upper drive sprocket and the first roller sprocket;

a second roller located a distance from the lower drive sprocket, having an axle parallel to the double drive sprocket axle, and having a second roller sprocket; and a lower chain drive operatively seated with and connecting the lower drive sprocket and the second roller sprocket;

wherein the first roller and upper chain lie in a first line intersecting the double drive sprocket axle, and the second roller and lower chain lie in a second line intersecting the double drive sprocket axle, so that said first line is at an angle to said second line to make the drive system generally a v-shape; and an engagement system comprising an engagement assembly connected to and extending from the base opposite and spaced from the drive system for rotatably clamping the pipe length against the first and second rollers.

* * * * *